US008967995B1

(12) United States Patent
Griffin et al.

(10) Patent No.: US 8,967,995 B1
(45) Date of Patent: Mar. 3, 2015

(54) HIGH-EFFICIENCY DUAL FLARE SYSTEM

(71) Applicants: Danny Edward Griffin, Lewisville, TX (US); Andrew Avila, Jr., Fort Worth, TX (US)

(72) Inventors: Danny Edward Griffin, Lewisville, TX (US); Andrew Avila, Jr., Fort Worth, TX (US)

( * ) Notice: Subject to any disclaimer, the term of this patent is extended or adjusted under 35 U.S.C. 154(b) by 19 days.

(21) Appl. No.: 14/047,709

(22) Filed: Oct. 7, 2013

Related U.S. Application Data

(63) Continuation of application No. 13/967,082, filed on Aug. 14, 2013.

(51) Int. Cl.
*F23G 7/08* (2006.01)

(52) U.S. Cl.
CPC ..... *F23G 7/085* (2013.01)
USPC ..... 431/5; 431/202

(58) Field of Classification Search
CPC ..... F23G 7/08; F23G 7/085
USPC ..... 431/5, 202
See application file for complete search history.

(56) References Cited

U.S. PATENT DOCUMENTS

| | | | | | |
|---|---|---|---|---|---|
| 3,709,654 | A | * | 1/1973 | Desty et al. | 431/284 |
| 3,822,984 | A | * | 7/1974 | Straitz, III | 431/283 |
| 3,822,985 | A | * | 7/1974 | Straitz, III | 431/284 |
| 3,824,073 | A | * | 7/1974 | Straitz, III | 431/284 |
| 3,893,810 | A | * | 7/1975 | Lientz | 422/111 |
| 3,901,643 | A | * | 8/1975 | Reed et al. | 431/202 |
| 3,915,622 | A | * | 10/1975 | Desty et al. | 431/284 |
| 3,995,986 | A | * | 12/1976 | Straitz, III | 431/114 |
| 4,025,281 | A | | 5/1977 | Lapp | |
| 4,065,110 | A | * | 12/1977 | Koenig | 266/78 |
| 4,105,394 | A | * | 8/1978 | Reed et al. | 431/202 |
| 4,128,389 | A | | 12/1978 | Straitz, III | |
| 4,227,872 | A | | 10/1980 | Zink et al. | |
| 4,336,017 | A | | 6/1982 | Desty | |
| 4,468,193 | A | | 8/1984 | Lawrence et al. | |
| 4,573,906 | A | * | 3/1986 | Schwartz et al. | 431/202 |
| 4,579,521 | A | * | 4/1986 | Schwartz et al. | 431/202 |
| 4,604,047 | A | * | 8/1986 | Coulthard | 431/5 |
| 4,637,793 | A | * | 1/1987 | Schwartz et al. | 431/202 |
| 4,652,232 | A | * | 3/1987 | Schwartz et al. | 431/202 |

(Continued)

FOREIGN PATENT DOCUMENTS

CA 2285811 A1 * 4/2001

OTHER PUBLICATIONS

"Elyxxon Engineering and Construction Limited", URL www.elyxxon.com.

(Continued)

*Primary Examiner* — Avinash Savani
(74) *Attorney, Agent, or Firm* — Shaukat A. Karjeker; Carstens & Cahoon, LLP

(57) ABSTRACT

A dual-pressure flare system and a method of its use. The dual-pressure flare system includes a dual-pressure flare stack having a central axis that is aligned with the center of a high-pressure outlet; a high-pressure flue having a central axis that is co-linear with the central axis of the dual-pressure flare stack; and a low-pressure flue connected to a low-pressure tip. Some exemplary embodiments of the system further include an air-assist assembly having an air-supply connection connected to an air blower and a mixing chamber, wherein the mixing chamber surrounds the low-pressure tip. In some exemplary embodiments, the air-supply connection is disposed outside the dual-pressure flare stack and the high-pressure flue.

14 Claims, 7 Drawing Sheets

(56) References Cited

U.S. PATENT DOCUMENTS

| | | | | | |
|---|---|---|---|---|---|
| 4,741,691 | A * | 5/1988 | Messimer | 431/202 |
| 4,892,477 | A * | 1/1990 | Zimmiond | 431/202 |
| 5,429,496 | A * | 7/1995 | Stephens et al. | 431/202 |
| 5,788,477 | A * | 8/1998 | Jones | 431/202 |
| 5,803,726 | A | 9/1998 | Bacon | |
| 5,807,095 | A * | 9/1998 | Gustafson et al. | 431/202 |
| 5,848,884 | A * | 12/1998 | Haustein et al. | 431/202 |
| 5,882,187 | A * | 3/1999 | Gustafson et al. | 431/202 |
| 6,494,710 | B2 * | 12/2002 | Kim et al. | 431/202 |
| 6,840,761 | B2 * | 1/2005 | Hong et al. | 431/202 |
| 6,960,075 | B2 * | 11/2005 | Rajewski | 431/202 |
| 7,354,265 | B2 | 4/2008 | Mashhour et al. | |
| 7,520,743 | B1 * | 4/2009 | Roberts | 431/5 |
| 7,677,882 | B2 * | 3/2010 | Harless | 431/202 |
| 7,677,883 | B2 * | 3/2010 | Harless | 431/202 |
| 7,878,798 | B2 * | 2/2011 | Poe et al. | 431/351 |
| 8,096,803 | B2 * | 1/2012 | Mashhour et al. | 431/202 |
| 8,172,565 | B2 * | 5/2012 | Duesel et al. | 431/5 |
| D671,204 | S * | 11/2012 | Kovash et al. | D23/415 |
| 2005/0053887 | A1 | 3/2005 | Westergaard | |
| 2007/0077528 | A1 * | 4/2007 | Sheridan | 431/202 |
| 2007/0231758 | A1 * | 10/2007 | Harless | 431/202 |
| 2007/0231759 | A1 * | 10/2007 | Harless | 431/202 |
| 2008/0145807 | A1 * | 6/2008 | Mashhour et al. | 431/202 |
| 2012/0015308 | A1 * | 1/2012 | Hong et al. | 431/5 |
| 2012/0315587 | A1 | 12/2012 | Gross-Petersen | |

OTHER PUBLICATIONS

"Flare Systems" Brochure, John Zink Company, LLC, 2001, URL http://www.johnzink.com/wp-content/uploads/flar_SYSTEMS1.pdf.

"Production Flares" Brochure, John Zink Company, LLC, 2004, URL http://www.johnzink.com/wp-content/uploads/production-flares.pdf.

Product Prochure 2009, TCI USA, Inc., Page last updated on Apr. 9, 2012, URL http://www.tciusainc.com/ProductBinderUSA2009.pdf.

"Air Assisted Flare" Brochure, Zeeco, Inc., 2011, URL http://www.zeeco.com/pdfs/AF.pdf.

* cited by examiner

HIGH-EFFICIENCY DUAL FLARE SYSTEM

RELATED APPLICATIONS

This application is a continuation of and claims priority from U.S. Ser. No. 13/967,082 filed on Aug. 14, 2013.

TECHNICAL FIELD

The present invention relates in general to a gas flare and more particularly to a dual-pressure gas flare system.

BACKGROUND

In oil and gas operations (e.g., oil and gas processing plants, wells, offshore rigs, and landfills), situations arise that may necessitate burning of combustible waste gases from time to time. Environmental laws and regulations and ecological considerations require that these gases be burned with a smokeless efficiency before being released into the atmosphere. For example, the United States Environmental Protection Agency (EPA) regulations (40 C.F.R. §60.18) require that a gas flare operate at the destruction and removal efficienty (DRE) of 98% or greater. DRE is the percent removal of hydrocarbon from the flare vent gas. The EPA regulations provides empirically derived equations that use variables such as flare type, the net heating value of the gas being combusted, and the exit velocity of the gas to indirectly determine if a flare is operating at a DRE of 98%. In other words, the EPA assumes that a flaring meeting the operating condition requirements of 40 C.F.R. §60.18 operates at a DRE of 98%. But even if a flare is operating at the regulatory criteria, the actual DRE can often be lower than 98%. So a system that operates in compliance with the regulations can still produce a significant amount of smoke, which may raise environmental concerns.

The gases that need to be flared vary in composition and pressure. High-pressure gases generally have sufficient kinetic energy and do not require additional energy to be imparted to the flaring system to burn smokelessly. But low-pressure hydrocarbon gases, having a hydrogen-to-carbon molecular weight ratio of less than 0.3, 0 produce smoke as a result of incomplete combustion and the formation of free carbon. Various systems and methods for coping with smoke generation have been proposed. One method uses steam or water as smoke suppressant. Others use a supply of high-pressure gas to increase hydrogen-to-carbon ratio. Another method uses forced air to provide turbulent mixing of air with the hydrocarbon gas for complete smokeless combustion. Providing additional kinetic energy and oxygen to the low-pressure gas supply can increase the DRE. This method is typically referred to as "air-assist flaring." This type of air-assisted flaring is advantageous when neither steam nor assist gas is available because a simple air blower can be used to provide forced air. Some air-assisted flare systems suffer from inefficiencies due to over-assisting, i.e., providing more assist air than is necessary or providing assist air but not actually increasing the DRE.

An oil and gas operation may need to vent both high- and low-pressure gases at various times. Because low-pressure gases require additional assist systems (e.g., steam, gas, or air), separate flare systems are often used for the different pressure waste gases. Some have proposed designs for a single flare system that is capable of processing both low and high pressure waste gases, but these systems have certain limitations and inefficiencies. U.S. Pat. No. 3,822,985 issued to John F. Straitz, III ("Straitz patent") discloses a flare stack gas burner for waste combustible gases at both low and high pressure with separate delivery systems for each. The Straitz patent teaches a central flare stack with a low-pressure gas delivery tube disposed inside. A separate tube feeds air into the central flare stack to mix with the low-pressure gas with a swirling action caused by the burner tip design. High-pressure gas delivery tube is disposed entirely outside of the central stack, and feeds into a manifold at the burner tip. There are several major inefficiencies associated with the system as disclosed in Straitz patent. First, the blown air must travel the entire inner space/volume of the central stack before it mixes with the low-pressure gas. This results in a significant loss of kinetic energy, which in turn results in smoke formation. Second, a blower with a large capacity and high power must be used to deliver sufficient forced air through the central stack. Third, to be operative, one must use the specialized burner assembly with a plurality of low-pressure and high-pressure apertures organized in a ring fashion at the burner tip. Finally, an existing gas flare cannot be retrofitted to provide for a system that is capable of processing both low- and high-pressure gases.

U.S. Pat. No. 4,105,394 issued to Robert D. Reed ("Reed patent") discloses a smokeless burner apparatus for single structure flare systems capable of burning waste gases from high and low pressure sources. Like the Straitz patent, the Reed patent teaches a specialized burner assembly with a hub-and-spokes design. The low-pressure gas delivery pipe is again disposed within the central stack. Forced air is blown through the entire inner space of the central stack before mixing with low-pressure gas. High-pressure gas delivery pipe is disposed within the central stack. The apparatus of the Reed patent suffers from several of the same inefficiencies as the apparatus of the Straitz patent.

Another problem faced by previous gas flares is the presence of liquids in the waste gases from the oil or gas production stream or from storage tank battery. Most oil and gas operations have a gas-liquid separator (also known as a "knockout drum" or a "scrubber") upstream of the flare to remove water or oil from the waste gas being combusted. Often, even with the upstream scrubbing step, not all of the liquid is removed. This can be due to the inefficiencies, overload, or failure of the upstream gas-liquid separator. The free liquids entrained in the gas streams travel and build up in the gas delivery system. This can cause inefficient burning of the gases, and may necessitate cleanup or replacement of gas flare system.

Another problem posed by previous gas flares is the level of noise produced by the system. While some flaring units are used in rural settings where the noise is of little concern, many flaring units are used quite close to residential areas. Furthermore, even in sparsely populated locations, the operators of the flaring units will have to approach the system from time to time. Extended exposure to a high level of noise can be detrimental to human auditory system.

SUMMARY

The following is a summary of some aspects and exemplary embodiments of the present technology, of which a more detailed explanation is provided under the Detailed Description section, here below. In accordance with one aspect of an exemplary embodiment, a dual-pressure flare system and the method of its use are provided which substantially eliminates or reduces disadvantages associated with previous gas flare systems and methods.

In accordance with one aspect of an exemplary embodiment, a dual-pressure flare system is disclosed, which includes: (a) a dual-pressure flare stack having a central axis, a high-pressure chamber having a high-pressure inlet and a high-pressure outlet, a low-pressure chamber having a low-pressure inlet and a low-pressure outlet, wherein the center of the high-pressure outlet is aligned with the central axis; (b) a high-pressure flue having a central axis that is co-linear with the central axis of the dual-pressure flare stack, a first end connected to the high-pressure outlet, a second end connected to a high-pressure tip; and (c) a low-pressure flue having a first end connected to the low-pressure outlet, a second end connected to a low-pressure tip. Some exemplary embodiments of the system further includes an air-assist assembly having an air-supply connection having a first end connected to an air blower and a second end connected to a mixing chamber, wherein the mixing chamber surrounds the low-pressure tip. In exemplary embodiments, the air-supply connection is disposed outside the dual-pressure flare stack and the high-pressure flue.

In accordance with another aspect of an exemplary embodiment, a method of operating a dual-pressure flare is disclosed, which includes: (a) providing a dual-pressure flare system having a dual-pressure flare stack, a high-pressure flue, a low-pressure flue, an air-assist assembly, a pilot assembly, and remote control panel; wherein the dual-pressure flare stack having a central axis, a high-pressure chamber having a high-pressure inlet and a high-pressure outlet, a low-pressure chamber having a low-pressure inlet and a low-pressure outlet, wherein the center of the high-pressure outlet is aligned with the central axis; wherein high-pressure flue having a central axis that is co-linear with the central axis of the dual-pressure flare stack, a first end connected to the high-pressure outlet, a second end connected to a high-pressure tip; and wherein low-pressure flue having a first end connected to the low-pressure outlet, a second end connected to a low-pressure tip; (b) supplying a high-pressure gas stream into the high-pressure inlet; (c) supplying a low-pressure gas stream into the low-pressure inlet; (d) mixing assist-air to the low-pressure gas stream near the low-pressure tip; (e) igniting a pilot light using the pilot assembly; and (f) combusting the high-pressure gas stream and the low-pressure gas stream at a hydrocarbon destruction and removal efficiency of at least 98 percent.

Exemplary embodiments may provide a number of technical advantages. For example, according to an exemplary embodiment, the assist air is blown through a narrower conduit of a smaller volume, which reduces the amount of kinetic energy that is lost. With the assist air being blown only through the low-pressure flue that is outside dual-pressure stack, an air blower with a smaller capacity and lower power can be used because the assist air need not flow through the entire volume of the central stack. The presence of multiple transitions in the high-pressure flue combined with efficient delivery of assist air through the smaller volume of the low-pressure flue results in hydrocarbon destruction efficiency that is far superior to previous flare systems.

Another technical advantage associated with an exemplary embodiment is its flexibility and versatility. In an exemplary embodiment of the gas flare system, the flare tip does not use a complex or specialized burner tip assembly as is required in previous dual-pressure gas flare systems. The high-pressure flare tip and the low-pressure tip operate substantially independently of each other, and one can be replaced with a new part without having to replace the other. Similarly, the air blower can easily be replaced in the event of its failure without the need to interrupt the operations of the high-pressure flare.

Yet another technical advantage associated with an exemplary embodiment is its additional safety measures. Even in the event of the failure of an upstream gas-liquid separator, the dual-pressure gas flare system according to some exemplary embodiments is capable of removing liquids entrained in both the high-pressure and low-pressure gas streams.

Exemplary embodiments may enjoy some, all, or none of these advantages. Other technical advantages may be readily apparent to one skilled in the art from the following figures, description, and claims.

BRIEF DESCRIPTION OF FIGURES

The foregoing aspects and many of the attendant advantages, of the present technology will become more readily appreciated by reference to the following Detailed Description, when taken in conjunction with the accompanying simplified drawings of exemplary embodiments. The drawings, briefly described here below, are not to scale, are presented for ease of explanation and do not limit the scope of the inventions recited in the accompanying patent claims.

DETAILED DESCRIPTION

I. Overview of the System

Figure 1:
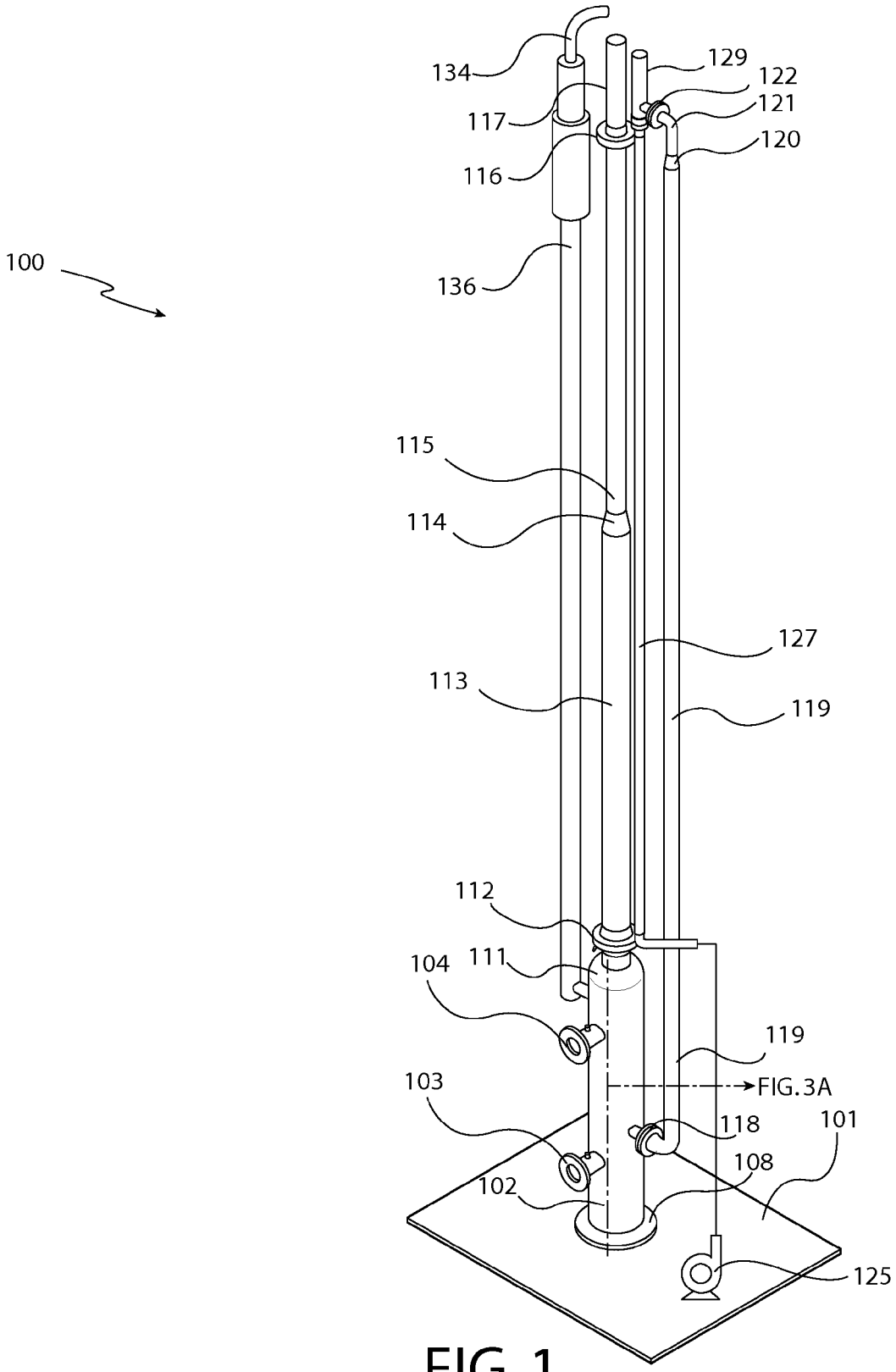
FIG. 1 illustrates a perspective view of a dual-pressure gas flare system according to an exemplary embodiment.
Figure 2:
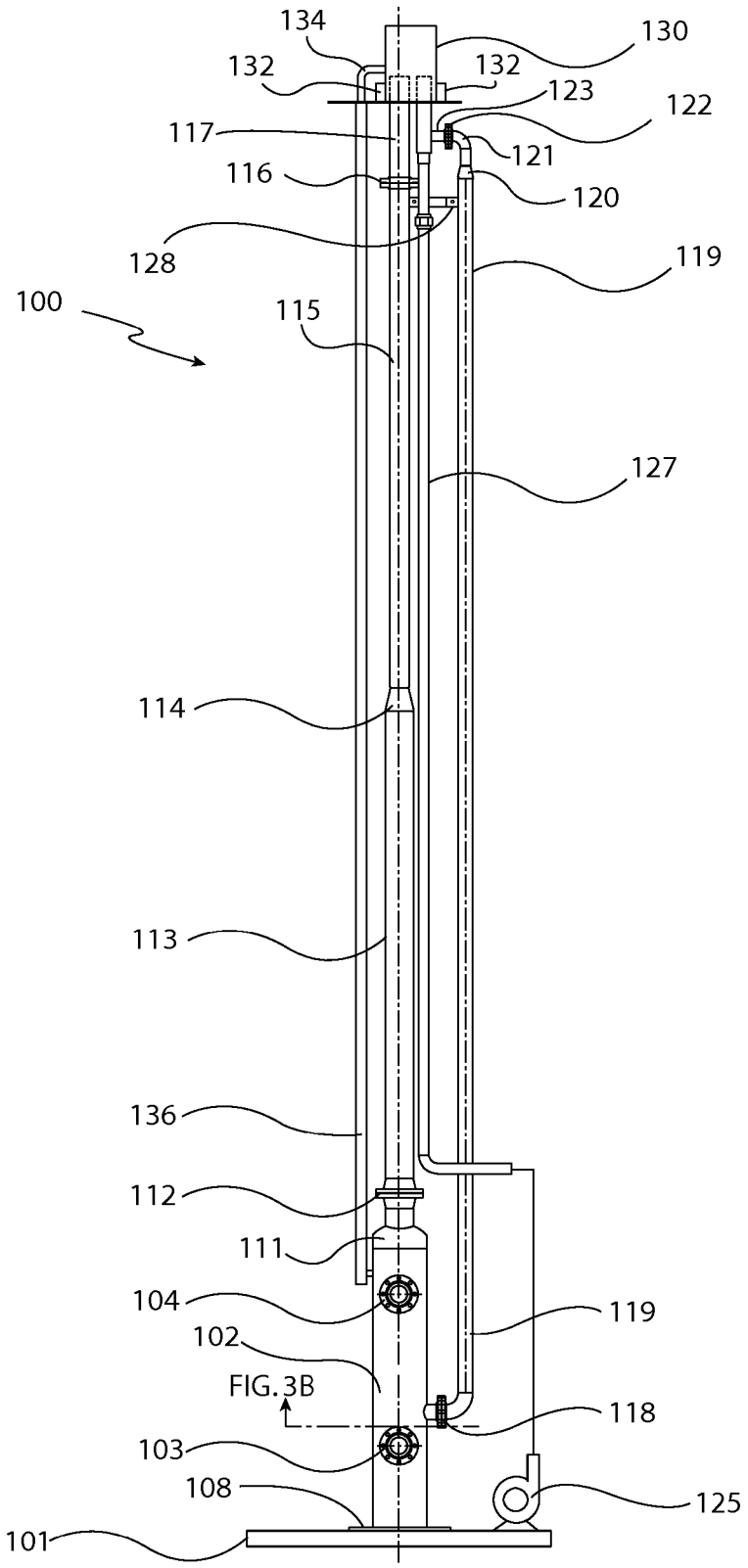
FIG. 2 illustrates an elevation view of a dual-pressure gas flare system according to an exemplary embodiment

FIG. 1 and FIG. 2 illustrate an exemplary embodiment of the dual-pressure flaring system 100 that is capable of flaring both low-pressure and high-pressure gases independently. System 100 includes a base 101 that supports a dual-pressure stack 102. In some exemplary embodiments, the base 101 is fastened or mounted on to a concrete slab or an immovable platform (e.g., of an oil rig). In other embodiments, the base 101 is fastened or mounted on to a movable platform, such as a truck flatbed. In such embodiment, the dual-pressure flaring system 100 may be used as a temporary replacement system during a failure or outage of an existing, permanent system. The system 100 can be moved to a new location at a hydrocarbon production field or a tank battery based on the changes in the need for a flaring system.

A. Dual Stack with Integrated Gas-Liquid Separator

Figure 3A:
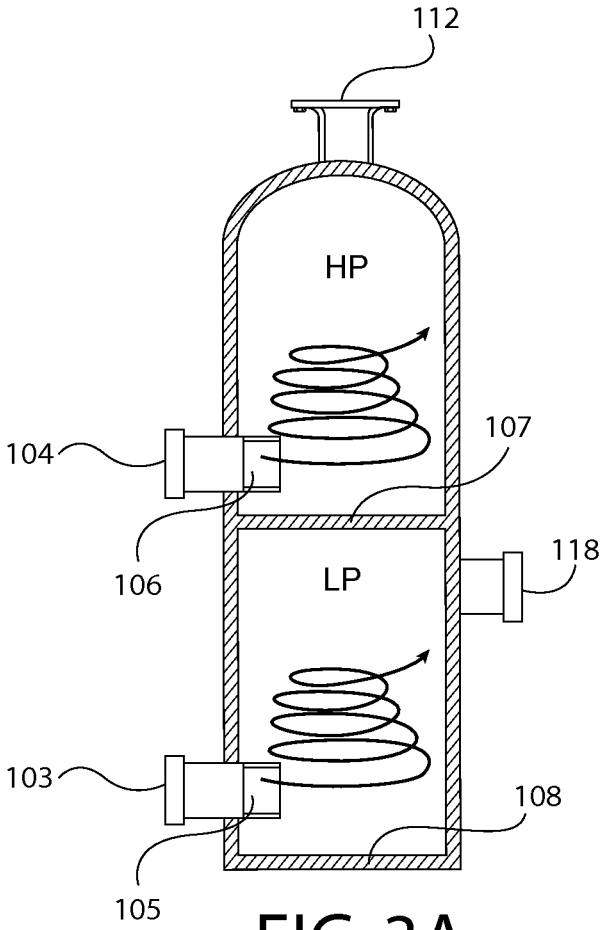
FIG. 3A illustrates a vertical cross-sectional view of the dual-pressure gas flare system along the line shown on FIG. 1 according to an exemplary embodiment.

As illustrated in FIG. 3A, the dual-pressure stack 102 is divided into two chambers: one for LP gas and the other for HP gas. As used herein, high-pressure gas means gas that has sufficient kinetic energy and do not require additional energy imparted to it to burn smokeless. In an exemplary embodiment, high-pressure gas has a pressure level of about 10 psi to about 100 psi. As used herein, low-pressure gas means gas that does not have sufficient kinetic energy and require additional energy to be imparted to it to burn smokelessly. In an embodiment, low-pressure gas has a hydrogen-to-carbon molecular weight ratio of less than 0.30 and produces smoke as a result of incomplete combustion and the formation of free carbon. In an exemplary embodiment, low-pressure gas has a pressure level of about 0.1 psi to about 0.75 psi. In an exemplary embodiment, the dual-pressure stack 102 has a low-pressure (LP) gas inlet 103 and a high-pressure (HP) gas inlet 104.

Figure 3B:
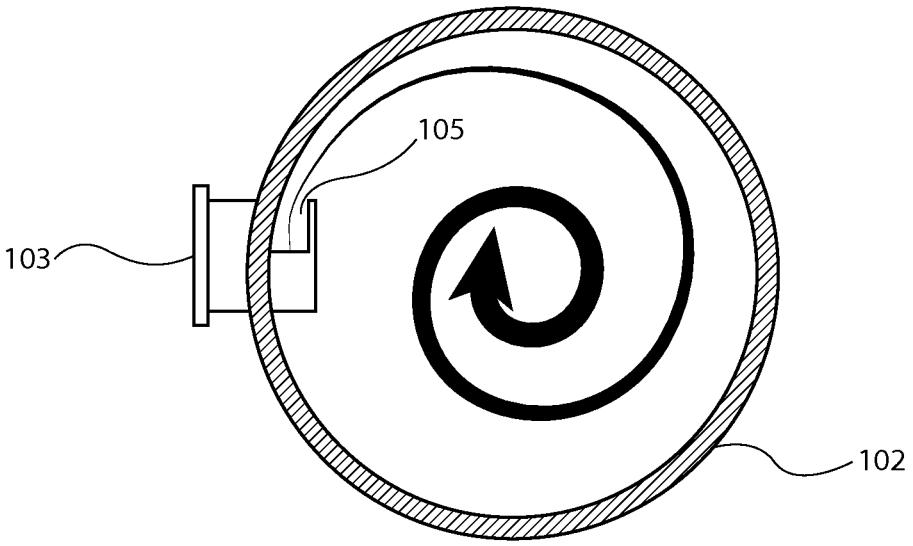
FIG. 3B illustrates a horizontal cross-sectional view of the dual-pressure gas flare system along the line shown on FIG. 2 according to an exemplary embodiment.

In some exemplary embodiments, the LP gas inlet 103 and the HP gas inlet 104 are designed and configured to cause the inflowing gas streams to travel in a vortical (or helical) flow. For example, in the embodiment illustrated in FIG. 3B, the LP gas inlet 103 has a pipe that extends into the interior of the dual-pressure stack 102 and is capped on the end. The LP gas inlet 103 pipe has an opening 105 that is directionally disposed towards the interior wall of the dual-pressure stack 102. As the inflowing gas exits the LP gas inlet opening 105, the gas stream substantially follows the circumferential path along the interior wall of the dual-pressure stack 102 as indicated by the inward spiraling arrow. The inlet opening 105 can be any other device known to be cable of imparting a vorticular flow to fluid in other embodiments. Because the inflowing gas has lower density compared to the interior environment of the dual-pressure stack 102, the gas stream rises as it follows the circumferential path. This results in the gas stream forming a vortex as it travels up the dual-pressure stack 102. The vorticular flow of the gases generate centrifugal force that causes the liquids entrained in the gas stream to separate out during the upward travel along the vorticual path.

Similarly, the HP gas inlet 104 has an opening 106 that is directionally disposed towards the interior wall of the dual-pressure stack 102. As with the inflowing LP gas, the inflowing HP gas follows a circumferential path along the interior wall of the dual-pressure stack 102 and travels up in a vorticular path. The entrained liquid in the HP gas stream falls out due to the centrifugal force. The liquids that fall out of HP gas stream collects on the HP base surface 107, and the liquids that fall out of the LP gas stream collects on the LP base surface 108. The HP base surface 107 acts as a separator between the LP chamber and the HP chamber of the dual-pressure stack 102. The liquid that collects and accumulates in the LP and HP chambers is removed through the liquid evacuation outlets 109 and 110, respectively (as shown more clearly in FIG. 6).

In an exemplary embodiment, the dual-pressure stack 102 has a height of about 10 feet. In some embodiment, the dual-pressure stack 102 has outer diameter of about 4 inches to about 15 inches. In an exemplary embodiment, the dual-pressure stack 102 has an inner diameter of about 12 inches. The diameter of the dual-pressure stack 102 can be varied to increase the volume of gas processed. The thickness of the dual-pressure stack 102 wall ranges from about 0.250 inch to about 0.375 inch in an exemplary embodiment. Because the HP chamber is in a vertically stacked arrangement over the LP chamber, the dual-pressure stack 102 has a reduced footprint. The dual-pressure stack 102 can be formed from any material that is able to withstand the pressure levels of the gases flowing through the system 100. Such materials include, in some embodiments, carbon steel and stainless steel.

B. High-Pressure Gas Flue

Returning to FIG. 1 and FIG. 2, the dual-pressure stack 102 narrows in diameter at the transition 111 as it approaches the HP outlet 112. While not being bound by any theory, it is believed that the narrowing of the diameter causes the HP gas to flow at a higher velocity. In some exemplary embodiments, the transition 111 reduces the inner diameter from the dual-pressure stack 102 to the HP outlet 112 by about 33% to about 66%. In an exemplary embodiment, the inner diameter of the HP outlet 112 is about 6 inches. The HP outlet 112, connects to HP flue 113. In an exemplary embodiment, HP outlet 112 and HP flue 113 have flanges that allows them to detachably connect. This allows the replacement of the HP flue without the need to change the dual-pressure stack. In some exemplary embodiments, the HP flue 113 height ranges from about 10 feet to about 40 feet. In an exemplary embodiment, the HP flue 113 height is about 20 feet.

In some exemplary embodiments of the system 100, the HP flue undergoes further reduction in diameter through one or more transitions 114. The HP flue transition 114 reduces the HP flue inner diameter by about 25% to about 50%. In an exemplary embodiment, the post-transition HP flue 115. diameter is about 3 inches. In some exemplary embodiments, the post-transition HP flue 115 height ranges from about 10 feet to about 35 feet. In an exemplary embodiment, the HP flue 113 height is about 15 feet.

Figure 4:
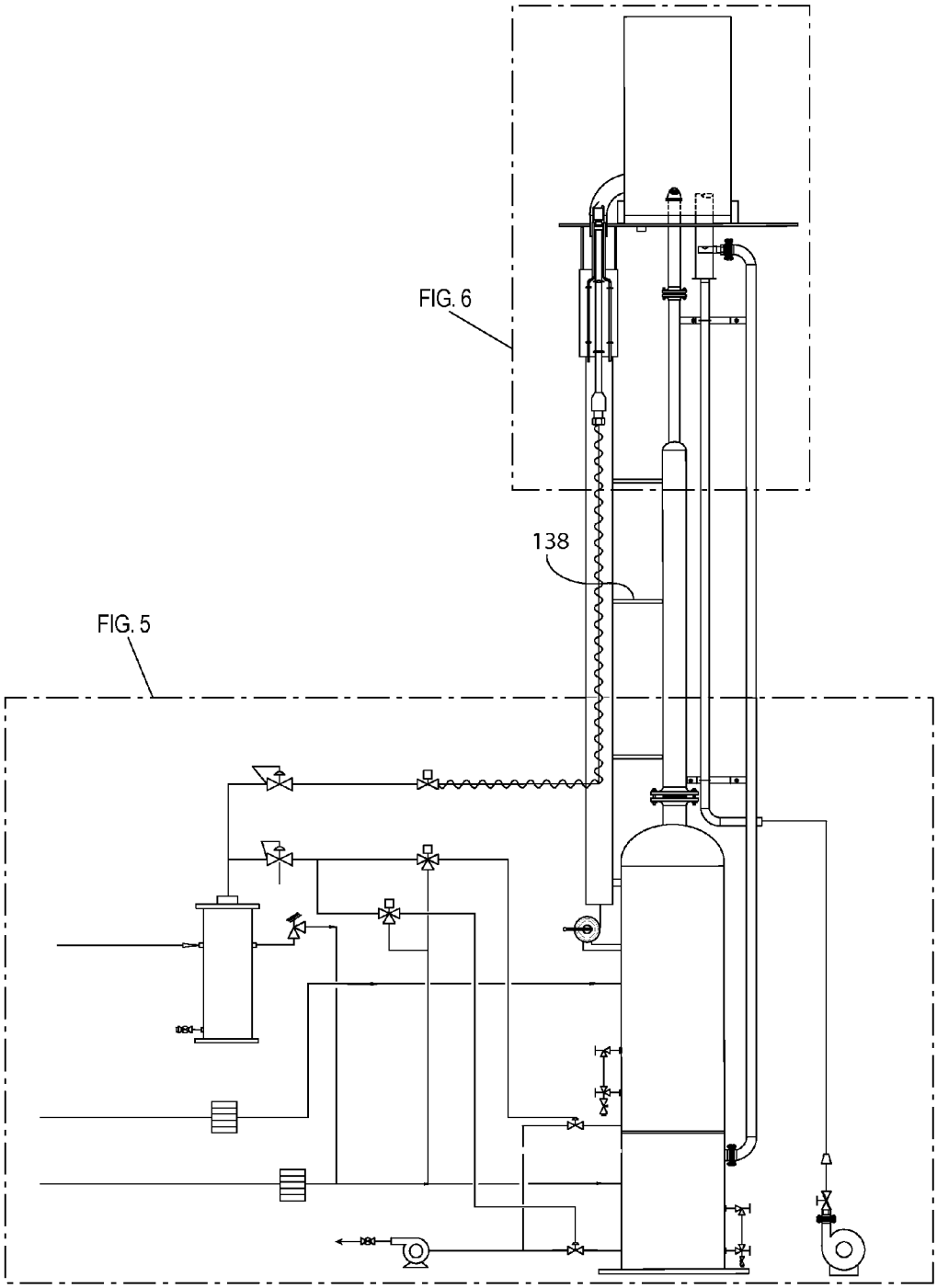
FIG. 4 illustrates a detailed elevation view of a dual-pressure gas flare system according to an exemplary embodiment.
Figure 5:
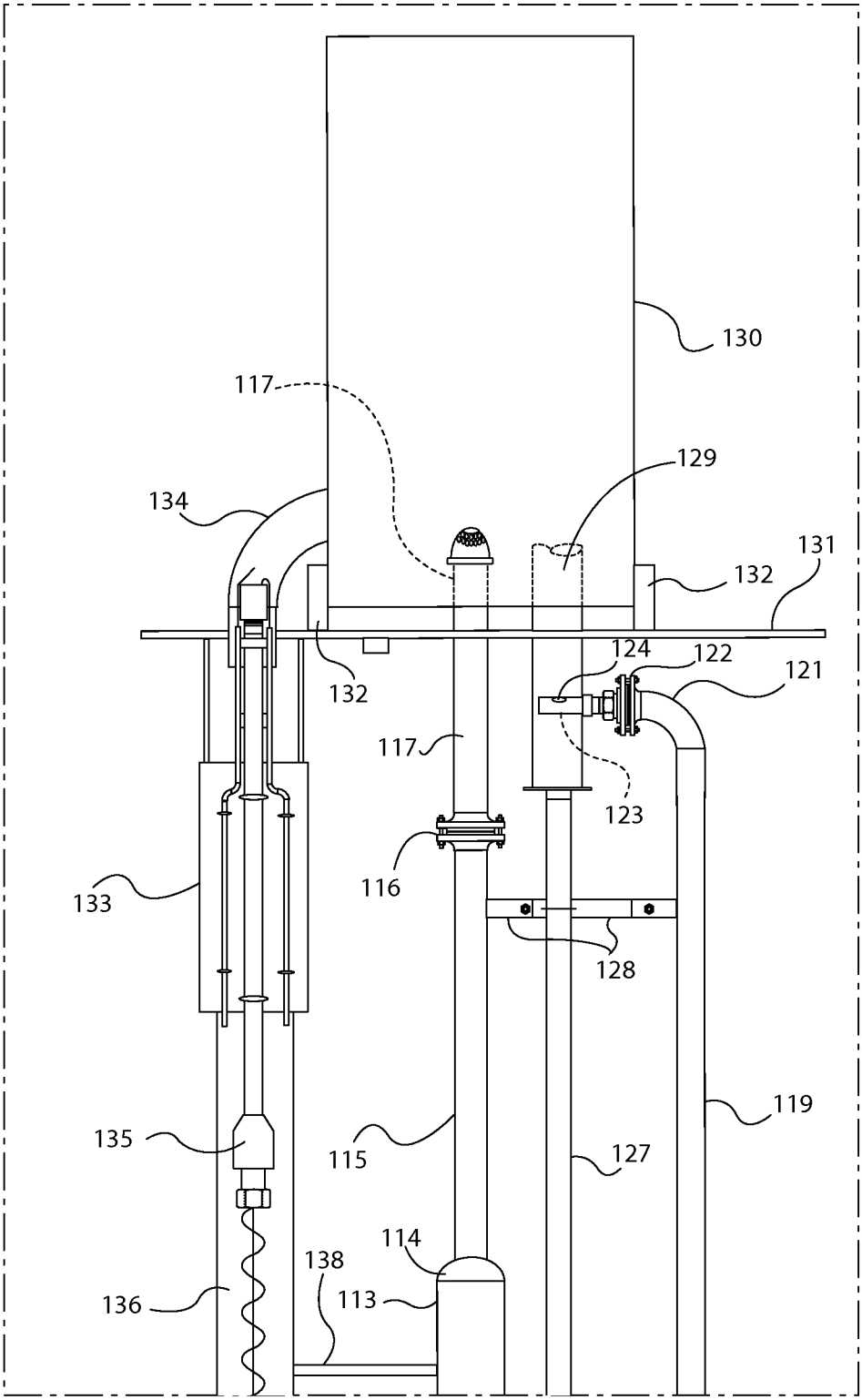
FIG. 5 illustrates a partial elevation view of a dual-pressure gas flare system shown in FIG. 4 according to an exemplary embodiment.

The post-transition HP flue 115 has flanges 116 that connects to the HP tip 117 in some exemplary embodiments. The flanges allow the HP tip 117 to detachably connect to the HP flue 115. In some exemplary embodiments, the tip 117 is narrower in diameter by about 25% to about 50% than the post-transition HP flue 115 further increasing the gas velocity. In some exemplary embodiments, the HP tip 117 height ranges from about 18 inches to about 24 inches. In an exemplary embodiment, the HP tip 117 height is about 20 inches. The HP tip 117 has an opening, which further narrows the exit diameter of the HP gas. In some embodiment, the HP tip 117 has a plurality of small openings as illustrated in FIG. 4 and FIG. 5. The decrease in diameter from HP outlet 112 to the tip 117 increases the exit velocity of the HP gas, which increases the DRE. This contributes to a cleaner burn of the HP gas compared to prior gas flare systems.

As used herein, HP flue means the portion from the point of the HP outlet 112 to the HP tip 117. In some exemplary embodiments, the height of the total height from the HP base 107 to the HP tip 117 ranges from about 25 feet to about 50 feet overall length. The heavier the hydrocarbon being combusted and the more volume of gas flowing through the system 100, the more heat is liberated by the flame. Thus, in exemplary embodiments, the height from the HP base 107 to the HP tip 117 is adjusted to maintain a safe level of heat for the operation personnel at the ground level.

C. Low-Pressure Gas Flue

The dual-pressure stack 102 has an LP outlet 118 that connects to the LP flue 119. The narrowing of the diameter from the dual-pressure stack 102 to the LP outlet 118 increases the LP gas velocity. In some exemplary embodiments, the LP outlet 118 is about 25% to about 50% narrower than the HP outlet 112. This further helps to increase the exit velocity of the LP gas. In an exemplary embodiment, the inner diameter of the LP outlet 118 is about 3 inches. The LP flue 119 has one or more transition(s) 120 that narrow the diameter of the LP flue 119. In some exemplary embodiments, the pre-transition LP flue 119 diameter ranges from about 4 inches to about 12 inches. In an exemplary embodiment, the pre-transition LP flue 119 diameter is about 3 inches. In some exemplary embodiments, the post-transition LP flue 119 diameter ranges from about 2 inches to about 6 inches. In some exemplary embodiments, the LP flue transition 120 narrows the inner diameter of the LP flue 119 by about 25% to about 50%. While FIG. 1 and FIG. 2 illustrate an embodiment of the 100 that has the transition 120 located towards the top, the transition 120 can be located substantially anywhere along the length of the LP flue 119.

In some exemplary embodiments, the LP flue 119 bends at substantially 90 degrees at the bend 121. In another embodiment, the LP flue 119 connects to a separate bend 121 piece (e.g., elbow) that is detachable. The LP flue bend 121 has flanges 122 that allows the LP tip 123 to detachably connect. In some exemplary embodiments, the LP tip 123 diameter ranges from about 2 inches to about 6 inches. As used herein, LP flue means the portions from the point of the LP outlet 118 to the LP tip 123. In some exemplary embodiments, the height of the LP flue matches the height of the HP flue so that the HP tip 117 and the LP tip 123 is substantially aligned. Thus, when compared to previous flares, the LP gas travels through a much smaller internal volume of the LP flue and is retains higher velocity.

The LP tip 123 has an opening 124, which further narrow the exit diameter of the LP gas. In some exemplary embodiments, the LP tip opening 124 diameter reduces the diameter by about 25% to about 50% compared to the diameter of the LP tip 123. As with the HP flue, the decrease in diameter in the LP flue 119 and at the LP tip opening 124 increases the exit velocity of the LP gas, which increases the DRE. While not being bound by any theory, it is believed that this contributes to a cleaner burn of the LP gas compared to prior gas flare systems. The bend 121 allows the LP tip opening 124 to be facing up towards the direction of the flow of the assist-air, which promotes a more efficient mixing of the LP gas with the assist air. It also prevents the blow-back of the LP gas and the assist air into the LP tip 123. Because the LP gas that exists the opening 124 and the assist air travels in the same direction, the assist air imparts additional kinetic energy to the LP gas and increases exit velocity.

D. Air-Assist Assembly

In an exemplary embodiment, the air-assist assembly includes an air blower 125, which provides additional kinetic energy and oxygen to the LP gas before the LP gas is burned. As illustrated in FIG. 1 and FIG. 2 and shown in further detail in FIG. 4, the blower 125 is connected to an air-assist supply hose 126 that connects to an air-assist pipe 127 in some exemplary embodiments. The air supply hose 126 diameter ranges from about 2 inches to about 4 inches in some exemplary embodiments. In some exemplary embodiments, the supply hose 126 allows for a tighter and more secure connection with the blower 125 than connecting the blower 125 directly to the pipe 127. The supply hose 126 also provides flexibility in placement or location of the blower 125. In other embodiments, the air blower 125 is connected directly to the air supply pipe 127.

The air-assist pipe 127 is attached to the HP flue 113, 115 and the LP flue 119 via support brackets 128 in an exemplary embodiment. In other embodiments, the air-assist pipe 127 is attached to the HP flue 113, 115 or the LP flue 119 using other suitable supporting mechanism. The air-assist pipe 127 is connect to the air-LP gas mixing chamber 129. In some exemplary embodiments, the air supply hose 126 is connected directly to the mixing chamber 129. The air-supply connection includes air supply hose 126, air-assist pipe 127, alone or in combination. As shown in detail in FIG. 5, the LP tip 123 is disposed inside the mixing chamber 129. In an exemplary embodiment, the mixing chamber ranges from about 12 inches to about 24 inches in diameter and from about 6 feet to about 12 feet in length. As noted above, the LP tip opening 124 is oriented upward so that the LP gas exits in the same direction as the flow of the air. This facilitates better mixing of the LP gas and the assist air, which results in a cleaner burn. Also, because the assist air is not blowing directly into the LP tip opening 124, it prevents the blow-back of the LP gas and the assist air into the LP tip 123. This promotes a more efficient use of the assist air. The top opening of the mixing chamber 129 is substantially at the same height as the HP tip 117 opening.

As used herein, air-assist assembly means the collection of components that supply the assist air to the system 100, including the air blower 125, air-supply connection, and the mixing chamber 129.

E. Hood Assembly

In some exemplary embodiments, the HP tip 117 and the opening of the mixing chamber 129 is surrounded by a flame hood 130. The flame hood 130 is a substantially cylindrical tube with the upper end substantially open, which directs the flames to flow upward. On the other end, the flame hood 130 has a sleeve 131 that prevents the flames from blowing down towards the HP tip 117, the mixing chamber 129, and the LP flue 119. The flame hood sleeve 131 thus reduces the wear and damage of the parts. In some exemplary embodiments, the flame hood sleeve 131 is detachable from the flame hood 130 so that the sleeve 131 can be replaced without having to replace the entire hood 130. In some exemplary embodiments, the flame hood 130 has one or more air holes 132. These flame hood air holes 132 allows ambient air to be drawn in to further facilitate a cleaner burn. The air that is drawn in through the air holes 132 also pushes the flames up toward the top opening of the flame hood 130. The flame hood 130 also acts to dampen the noise produced by the flaring operation.

F. Pilot Assembly

Gas flaring operations can be both continuous and intermittent. A pilot assembly 133 is used to maintain a constant source of flame in intermittent operations or in the event of a flame blow out in continuous operation. In an exemplary embodiment, as shown in detail in FIG. 5, a pilot pipe 134 on the flame hood 130 directs the pilot toward the HP tip 117 and the LP tip 123 in an exemplary embodiment. In some exemplary embodiments, the pilot assembly 133 houses a pilot igniter 135. The pilot igniter is raised up through the pilot assembly 133 through the guide rail 136 using the pilot winch 137 in an exemplary embodiment. The pilot guide rail 136 is attached to the HP flue 113, 115 at one or more points using support brackets 138. In other embodiments, the support brackets 138 are attached to 102 or the LP flue 119. The pilot igniter 135 is connected to pilot gas supply hose 139 in on embodiment. As used herein, pilot assembly means the collection of components that enable the system 100 to maintain and ignite a pilot light, including the pilot igniter 135, the pilot guide rail 136, and the pilot gas supply hose 139.

II. Operation of the System

Air-assisted flares increase the exit velocity of the low-pressure gas to facilitate a clean, smokeless burn. It is important to note, however, that regulatory limits exist as to how high the exit velocity can be. One such regulatory limits are outlined in the EPA regulation, 40 C.F.R. §60.18, which is incorporated herein by reference. For example, 40 C.F.R. §60.18(f) dictates that the maximum permitted velocity, $V_{max}$, for an air-assisted flare is to be determined by the following equation:

$$V_{max}=8.706+0.7084(H_T) \quad \text{Eqn. 1}$$

$V_{max}$ is the maximum permitted velocity (in meters per second, m/s). $H_T$ is the net heating value of the gas being combusted, which is calculated by the following equation:

$$H_T=K\Sigma_{i=1}^{n}C_iH_i \quad \text{Eqn. 2}$$

$H_T$ is the net heating value of the sample (in megajoules per standard cubic meter, MJ/scm), where the net enthalpy per mole of offgas is based on combustion at 25° C. and 760 mm Hg, but the standard temperature for determining the volume corresponding to one mole is 25° C. K is the constant:

$$K = 1.740 \times 10^{-7}\left(\frac{1}{\text{ppm}}\right)\left(\frac{\text{g mole}}{\text{scm}}\right)\left(\frac{\text{MJ}}{\text{kcal}}\right) \quad \text{Eqn. 3}$$

where the standard temperature for $$\left(\frac{\text{g mole}}{\text{scm}}\right)$$

is 20° C.

$C_i$ is the concentration of sample component i in ppm on a wet basis. $H_i$ is the net heat of combustion of sample component i (in kilocalories per mole, kcal/mole) at 25° C. and 760 mm Hg. In English units, Equation 1 is converted as follows:

$$V_{max}=28.54+0.087(H_T) \quad \text{Eqn. 4}$$

where $V_{max}$ is measured in feet per second (ft/s) and the $H_T$ is measured in British thermal units per standard cubic feet (Btu/scf).

For air-assisted flares, by regulation, only gases with net heating value of 11.2 MJ/scm (300 Btu/scf) or greater can be combusted. In a typical oil and gas production setting, the flare gas composition is dominated by methane, followed by ethane and some higher molecular weight hydrocarbons. The heating values for some component gases are provided below:

| Gases | Heating Value (Btu/scf) |
|---|---|
| methane | 1010.0 |
| ethane | 1769.6 |
| propane | 2516.1 |
| i-butane | 3251.9 |
| n-butane | 3262.3 |
| i-pentane | 4000.9 |
| n-pentane | 4008.9 |
| n-hexane | 4755.9 |

In an exemplar calculation, a mixture of gas having the net heating value, $H_T$, of 1500 Btu/scf would allow the air-assisted flare to operate at the maximum exit velocity, $V_{max}$, of 159 ft/s (48 m/s). For a gas mixture having $H_T$ of 2000 Btu/scf, the $V_{max}$ would be 202 ft/s (62 m/s).

Thus, it can be seen that increasing the DRE of the air-assisted flares is not merely a matter of supplying more kinetic energy and increasing the velocity of the low-pressure gas. The embodiments of the system 100 utilize the assist air more efficiently compared to previous flares. For example, in an exemplary embodiment, the assist air need only travel through a 2-inch diameter air-assist supply hose 126 and air-assist pipe 127 to reach the mixing chamber 129. Comparatively, previous flares require the use blowers with a very high capacity sufficient to fill the entire the inner volume of a wide (e.g., about 12 inches or greater) and long stack. Furthermore, in system 100, the loss of kinetic energy of LP gas is minimized because it travels through the narrow LP flue 119. Previous flares, on the other hand, routed the LP gas through the primary stack and mixed it with air in the large inner volume of the primary stack. In order to impart sufficient energy to send the gas up to the top of the stack, previous flares required high-capacity blowers, which often over-assisted without increasing the DRE. In an exemplary embodiment, system 100 uses a centrifugal blower 125 having a 1 horsepower motor supplying from about 200 to about 350 cubic feet per minute of assist air. This is significantly lower than typical previous air-assisted flares.

Another reason why it would be undesirable to simply increase the assist air capacity is the noise produced by the flaring system. Previous air-assist flares typically produce from about 96 decibels at about 100 feet away from the flare. Exemplary embodiments of the system 100, on the other hand, produce only about 90 to about 116 decibels of noise at about 100 feet away from the system 100. By using the assist air more efficiently—combined with the dampening effect provided by the flame hood 130—the noise level is greatly reduced.

Figure 6:
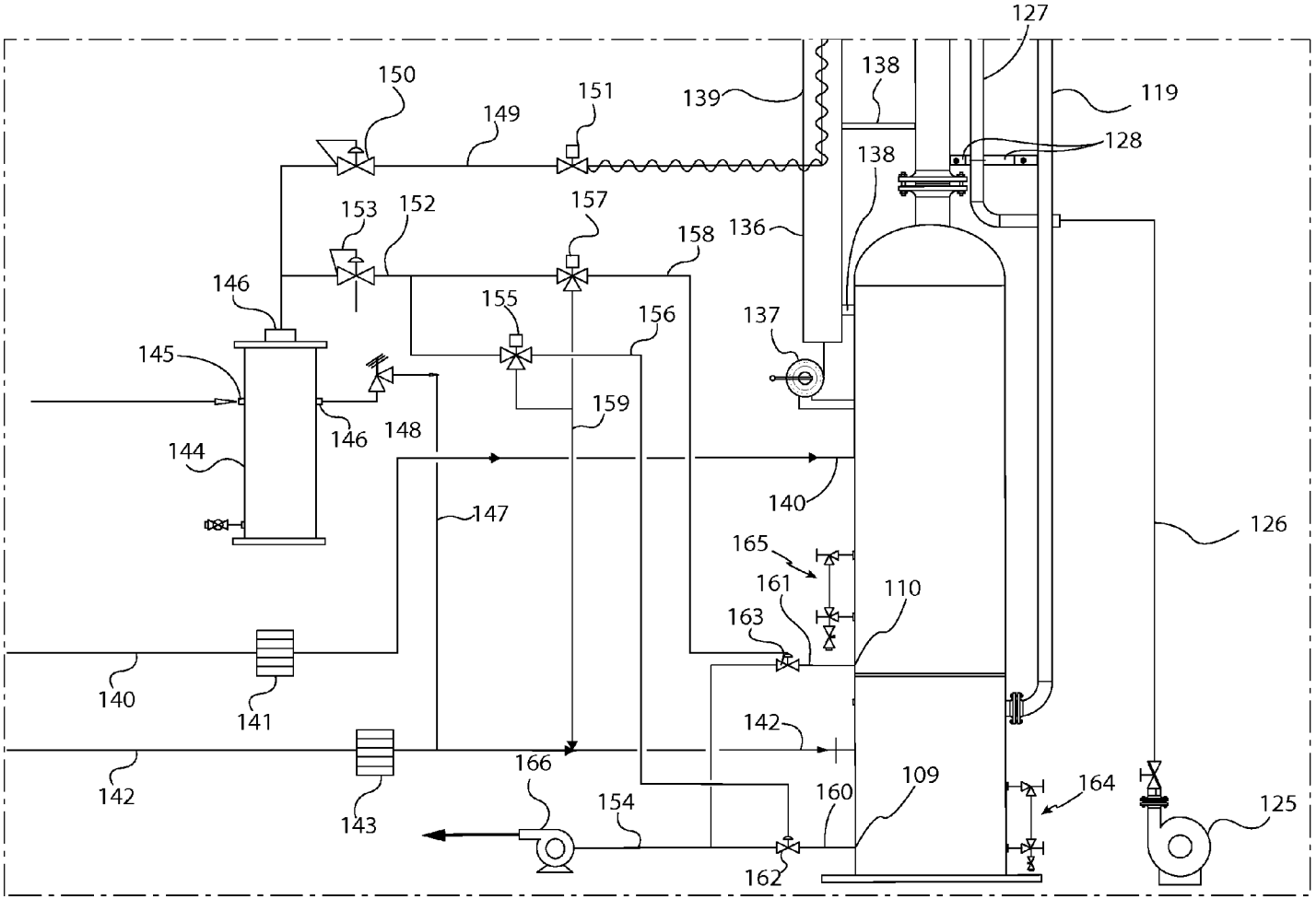
FIG. 6 illustrates a partial elevation view of a dual-pressure gas flare system shown in FIG. 4 according to an exemplary embodiment.
Figure 7:
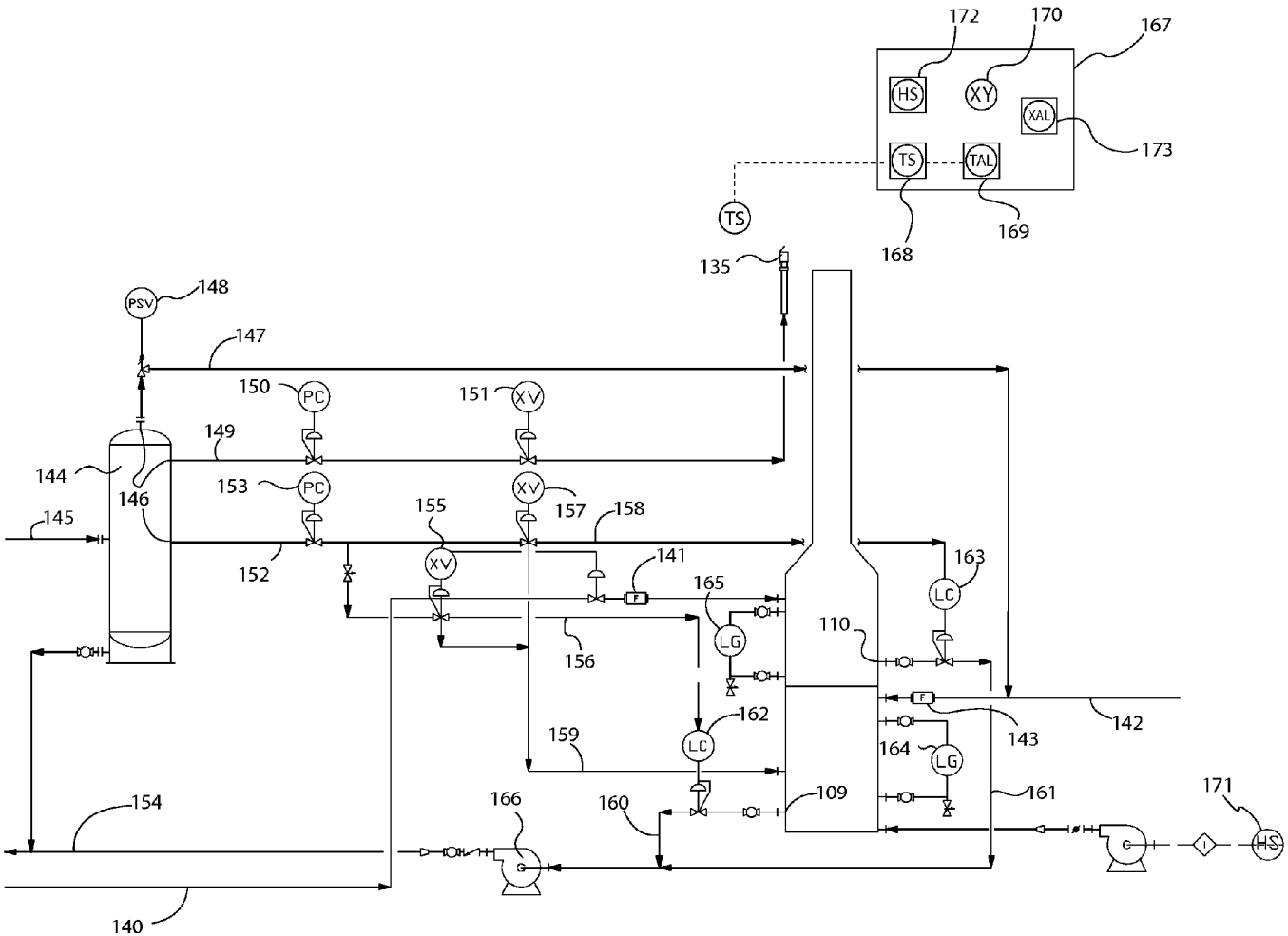
FIG. 7 illustrates a process flow diagram for method of using a dual-pressure gas flare system according to an exemplary embodiment.

The following is an exemplar description of the operation of system 100 in the context of use in an oil and gas production field. One such embodiment is illustrated in FIG. 6 and FIG. 7. But system 100 can be used in any industry or field where both high- and low-pressure waste gases need to be flared from time to time, including oil and gas exploration, production, and processing operations, chemical plants or industrial plants.

In the production field, the fluid extracted from a well typically have high pressure. The extracted well fluid goes through a separator that separates the liquid oil from the gas. The extracted gases sometimes need to be flared off whenever the processing equipment items are over pressured. This gas stream comprises the HP gas inlet stream 140 in an exemplary embodiment. As a precautionary measure, the HP gas inlet stream 140 passes through a flame arrestor 141 before feeding into the HP inlet 104. Even though the well fluid goes through a separator, some of the oil and/or water are entrained in the fast-traveling HP gas. Thus, the HP inlet opening 106 of the dual-pressure stack 102 causes the inflowing gas stream to travel in a vortical flow (as described above in Section I-A). The vortex naturally separates the entrained water and oil from the HP gas stream before the HP gas flows out of the HP outlet 112 into the HP flue 113.

In some oil and gas operations, the extracted oil is stored in tank battery until it is used or transported. The stored oil has dissolved gases that separate out of the liquid phase over time. This tank vapor comprises the LP gas inlet stream 142 in an exemplary embodiment. As with the HP inlet stream 140, the LP inlet stream 142 also passes through a flame arrestor 143 before feeding into the LP inlet 103. The LP gas inlet stream 142 sometime has entrained oil or water, which is removed by the vortical motion imparted by the LP inlet opening 105. The removal of entrained oil and water facilitates cleaner, smokeless burning of the gases.

To control the various components of the system 100 and to fuel the pilot assembly 133, the tank 144 provides the supply gas. The supply gas is pure methane in an exemplary embodiment; in other embodiments, the supply gas is any purified or mixture of hydrocarbon gases sufficient to serve as the pilot gas. The supply gas is fed into the supply gas tank 144 through the inlet 145. In some embodiment, the supply gas is pressurized to 40 to 80 pounds per square inch gauge (psig). In an exemplary embodiment, the supply gas tank 144 has three outlets 146. One of the outlets 146 feeds into the supply gas tank pressure relief line 147, which routes the excess gas to the LP inlet stream 142 when the tank 144 becomes over pressurized. In an exemplary embodiment, the supply gas tank pressure relief line 147 is controlled by a pressure relief valve 148. The second outlet 146 feeds into the pilot gas supply line 149. The amount of supply gas that feeds into the pilot gas supply line 149 is controlled by the pilot gas pressure regulator 150 and a pilot gas solenoid valve 151 in an exemplary embodiment. The third outlet 146 feeds into the control gas supply line 152. The control gas controls the liquid evacuation lines (described below). The control gas supply line 152 is regulated by a pressure regulator 153 in an exemplary embodiment.

When the dual-pressure stack 102 separates out the entrained oil and water from the HP and the LP gas streams, the liquid is collected and pumped out of the stack 102 through the liquid evacuation line 154. The amount of liquid collected on the LP base surface 107 will differ from that collected on the HP base surface 108. In some exemplary embodiments, when the field gas stream is particularly "wet," liquid will accumulate faster in the HP chamber than the LP chamber. System 100 accounts for this difference, determines when the two chambers need to be evacuated of the collected liquids, and independently controls the HP side and the LP side of the liquid evacuation line 154. This is enabled by using two separate liquid control valves, which uses the pressurized gas from the control gas supply line 152 that diverges into to separate control gas lines.

The LP control gas solenoid valve 155 controls the flow of the supply gas that is fed through the LP control gas supply line 156 in an exemplary embodiment. Similarly, the HP control gas solenoid valve 157 controls the flow of the supply gas that is fed through the HP control gas supply line 158 in an exemplary embodiment. These solenoid valves 155, 157 can also build up excess pressure upstream of the valve, which can be relieved to the LP gas inlet stream 142 through the solenoid valve pressure relief line 159.

The liquid that accumulates on the LP base surface 107 is removed or pumped out through the LP liquid evacuation line 160 in an exemplary embodiment. Similarly, the liquid that accumulates on the HP base surface 108 is removed or pumped out through the HP liquid evacuation line 161 in an exemplary embodiment. The two liquid evacuation lines 160, 161 are independently controlled by a LP liquid level controller 162 and a HP liquid level controller 163, respectively, in an exemplary embodiment. These liquid level controllers 162, 163 are triggered by LP level gauge 164 and HP level gauge 165, respectively. When the level gauges 165, 164 trigger their respective liquid level controllers 162, 163, the liquid evacuation pump 166 is activated to pump out the accumulated liquid from the dual-pressure stack 102. The liquid evacuation pump 166 thus only needs to operate when the liquid level controllers 162, 163 are triggered. This is a marked improvement over liquid evacuation pumps that are constantly pumping out minimal amounts liquid. As used herein, the liquid evacuation system means the collection of components that enable the accumulated liquids in the LP and HP chamber to be pumped out, including the control gas lines 152, 156, 158, regulator 153 and solenoid valves 155, 157, liquid evacuation lines 154, 160, 161, solenoid valve pressure relief line 159, level controllers 162, 163, level gauges 165, 164, and the liquid evacuation pump 166.

In some exemplary embodiments, a remote control panel 167, illustrated in FIG. 7, controls and monitors various components of the system 100. For example, in an exemplary embodiment, a temperature sensor 168, such as a thermocouple, senses whether the pilot light is on. If the sensor 168 indicates a temperature below a predetermined threshold, a pilot failure alarm 169 is activated. This allows an operator (or an automated system) to reignite the pilot light using a flare ignition controller 170, which activates the pilot igniter 135. This ensures that a flame will be present at all times, ready to combust any gas that is flared.

In some exemplary embodiments, the remote control panel 167 monitors a sensor 171 that detects the operation of the air blower 125. If the blower sensor 171 detects that the air blower 125 is not in operation or has suffered a failure, the remote control panel 167 activates an air blower failure alarm 172 in an exemplary embodiment. This will alert an operator to attend to the blower 125 and replace it if necessary. In other embodiments, when the air blower failure alarm 172 is activated, the remote control panel 167 switches on a secondary (or back-up) blower that is connected to the air supply hose 126 or the air supply pipe 127. This ensures that the LP gas will not be combusted without the assist air.

In an exemplar embodiment, the system 100 is capable of combusting from about 2000 to about 3000 standard cubic feet per day. This requires the supply of from about 250 to about 375 cubic feet per minute. In some embodiment, the system 100 operates at a DRE of from at least 98% to about 99%.

III. Alternate Embodiments

Although several exemplary embodiments have been described, a myriad of changes, variations, alterations, transformations, and modifications may be suggested to one skilled in the art, and it is intended that the present 7 disclosure encompass such changes, variations, alterations, transformations, and modifications as fall within the spirit and scope of the appended claims. Alternative embodiments that result from combining, integrating, or omitting features of the embodiments are also within the scope of the disclosure.

For example, instead of the various solenoid valves and regulators described above, system 100 can be controlled by various different types of control valves, including without limitation: back-pressure regulator with external tap, differential pressure reducing regulator, self-contained pressure regulator, piston-actuated shutdown valve, positioner with solenoid, electronic solenoid-operated valve, or diaphragm-actuated control valve. Various fluid inlets and outlets can be monitored and controlled using different types of flow meters and instruments, including without limitation: venturi, coriolis, turbine, roots, orifice flow meter, annubar flow meter, in-line flow meter, or other types of flow instruments. Similarly, the liquid evacuation system can be controlled by various types of level instruments, including without limitation: level gauge, level transmitter (differential-pressure type or external displacer chamber), magnetic level indicator with level switches, level control with internal displacer, level switch with an internal displacer or an external displacer chamber, or other types of level controllers. Various types of pressure indicators, gauges, regulators, diaphragms, or sensors can be used. The pilot sensor 168 can utilize various types of temperature instruments, including without limitation: temperature indicator, temperature transmitter, thermowell, thermocouple, temperature recorder, or temperature indicating controller can be used. Various valves can be places in several locations along the fluid inlets and outlets to further control the flow of the gas or liquid streams, including without limitation: ball valve, globe valve, check valve, gate valve, plug valve, butterfly valve, needle valve, or other types of valves. The length, width, height, depth, diameter, temperature, pressure, or flow measurements given herein are illustrative and not meant to be limiting. While the air-supply connection 127, 126 and the pilot guide rail 136 were disclosed as being connected with a set of support brackets 128, 138, the air-supply connection 127, 126 and the pilot guide rail 136 can be connected to the HP flue 113, the dual-pressure stack 102, or the LP flue 119 using any supporting mechanism capable of bearing the weight of the he air-supply connection 127, 126 or the pilot guide rail 136 and stably supporting them.

In order to assist the United States Patent and Trademark Office (USPTO) and any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit the scope of any inventions in any way that is not otherwise reflected in the appended claims.

What is claimed is:

1. A dual-pressure flare system comprising:

(a) a flare stack comprising a high-pressure chamber having a high-pressure gas inlet, a high-pressure gas outlet, and a low-pressure chamber having a low-pressure gas inlet and a low-pressure gas outlet, the low-pressure chamber and the high-pressure chamber in vertically stacked relationship;

(b) a vertically-extending high-pressure gas flue having a first end in fluid communication with the high-pressure gas outlet, a second end in fluid communication with a high-pressure tip;

(c) a vertically-extending low-pressure gas flue having a first end in fluid communication with the low-pressure gas outlet, a second end in fluid communication with a low-pressure tip; and (d) a flame hood surrounding the high-pressure tip, the flame hood comprising a plurality of flame hood air holes and a pilot light pipe.

2. The system of claim 1 wherein the high-pressure gas flue has a first inner diameter and a second inner diameter, wherein the second inner diameter is about 33% to about 66% smaller than the first inner diameter, and wherein the second inner diameter is downstream from the first diameter.

3. The system of claim 1 wherein the high-pressure gas flue has a first inner diameter and a second inner diameter, wherein the second inner diameter is about 25% to about 50% smaller than the first inner diameter, and wherein the second inner diameter is downstream from the first diameter.

4. The system of claim 1 wherein the high-pressure tip comprises at least one opening, wherein an opening diameter smaller than a high-pressure tip inner diameter by about 25% to about 50%.

5. The system of claim 1 wherein the low-pressure gas outlet is about 25% to about 50% narrower than the high-pressure gas outlet.

6. The system of claim 1 wherein the low-pressure gas flue further comprises a transition narrowing an inner diameter of the low-pressure gas flue by about 25% to about 50%.

7. The system of claim 1 wherein the low-pressure tip comprises at least one opening, wherein an opening diameter is smaller than a low-pressure tip inner diameter by about 25% to about 50%.

8. The system of claim 1 wherein the high-pressure gas inlet is configured to induce a vortical flow of the high-pressure gas.

9. The system of claim 1 wherein the low-pressure gas inlet is configured to induce a vortical flow of the low-pressure gas.

10. The system of claim 1 further comprising an air-assist assembly having a first end in fluid communication with an air blower and a second end in fluid communication with a mixing chamber, wherein the mixing chamber surrounds the low-pressure tip.

11. The system of claim 10 wherein the low-pressure tip opening is oriented in a direction of a flow of assist air supplied by an air-assist assembly.

12. The system of claim 1 further comprising a pilot light assembly located to provide flame to ignite gas exiting from the high pressure tip and the low pressure tip.

13. The system of claim 10 wherein the pilot assembly further comprises a pilot igniter and a pilot guide rail, wherein the pilot guide rail is structurally connected to the high-pressure flue with a plurality of support brackets, wherein the pilot igniter is elevated inside the pilot guide rail with a pilot winch, and wherein the pilot igniter is in fluid communication with a pilot gas supply hose.

14. A high efficiency air-assisted dual-pressure flare system comprising:

a vessel compartmentalized into a high pressure chamber and a low pressure chamber separated from each other; the high pressure chamber having a high-pressure gas inlet, and a high pressure gas outlet, and the low pressure chamber having a low pressure gas inlet and a low pressure gas outlet, the high pressure and low pressure chambers in vertically stacked relation to each other;

a high pressure gas inlet conduit in fluid communication with the high pressure chamber;

a low pressure gas conduit in fluid communication with the low pressure chamber;

a high pressure gas flue in fluid communication with the high pressure chamber and extending vertically from the high pressure gas chamber outlet to terminate in a high pressure burner having a burner tip, a diameter of the high pressure flue decreasing from a first diameter at the high pressure gas chamber outlet to a second diameter at the high pressure burner;

a low pressure gas flue in fluid communication with the low pressure chamber and extending vertically from the low pressure gas chamber outlet to terminate in a low pressure tip having a low pressure burner, a diameter of the low pressure flue decreasing from a first diameter at the low pressure gas chamber outlet to a second diameter at the low pressure burner;

an air-assist system comprising a blower, the blower controlledly directing air through an air conduit into the low pressure flue, the air conduit injecting air into the low pressure flue at a point proximate and below the low pressure flue tip to mix air into low pressure gas flowing in the low pressure flue in order to promote smokeless and efficient combustion of low pressure hydrocarbon gas in the low pressure burner at the low pressure flue tip; and a flame hood surrounding the high-pressure tip, the flame hood comprising a plurality of flame hood air holes and a pilot light pipe;

whereby, during flare operation, the dual flare system provides smokeless combustion and a destruction and removal efficiency of hydrocarbons of at least 98%, at a sound level of about 90 to about 116 decibels, as measured at a distance of 100 feet from the dual pressure flare system.

* * * * *